US005362076A

United States Patent [19]

Thomas et al.

[11] Patent Number: 5,362,076

[45] Date of Patent: Nov. 8, 1994

[54] PNEUMATIC PUMP ROLLER BLADES

[76] Inventors: Michael P. Thomas; Paul Thomas, both of 31731 Secoya, Coto De Caza, Calif. 92679

[21] Appl. No.: 48,307

[22] Filed: Apr. 19, 1993

[51] Int. Cl.[5] ..... A63C 17/06; A63C 17/26

[52] U.S. Cl. ..... 280/11.22; 280/811; 280/11.36; 36/54; 36/93; 36/115

[58] Field of Search ..... 280/11.19, 11.22, 11.23, 280/11.36, 841, 811; 36/54, 71, 89, 93, 114, 115, 119, 136

[56] References Cited

U.S. PATENT DOCUMENTS

| | | | |
|---|---|---|---|
| 3,664,043 | 5/1972 | Polumbus, Jr. | 36/71 |
| 3,823,952 | 7/1974 | Kukulowicz | 280/11.22 X |
| 4,638,579 | 1/1987 | Gamm | 36/114 X |
| 4,662,087 | 5/1987 | Beuch | 36/119 X |
| 4,726,126 | 2/1988 | Bernhard | 36/71 X |
| 4,730,403 | 3/1988 | Walkoff | 36/93 X |
| 4,744,157 | 5/1988 | Dubner | 36/93 X |
| 4,972,611 | 11/1990 | Swartz et al. | 36/114 X |
| 5,152,083 | 10/1992 | Gagne | 36/115 |

FOREIGN PATENT DOCUMENTS

| | | | |
|---|---|---|---|
| 2845824 | 5/1979 | Germany | 36/93 |

*Primary Examiner*—Brian L. Johnson
*Attorney, Agent, or Firm*—E. Michael Combs

[57] ABSTRACT

Shoe members having spaced parallel support flanges, wherein the flanges include a row of rotatably mounted wheels therebelow which are fashioned as a roller blade structure, having a pneumatic chamber within the side wall of the shoe structure of the roller blades employing a pneumatic pump bladder mounted relative to the tongue structure of the shoe to permit selective filling of the pneumatic side wall chamber.

3 Claims, 4 Drawing Sheets

PNEUMATIC PUMP ROLLER BLADES

BACKGROUND OF THE INVENTION

1. Field of the Invention

The field of invention relates to wheeled roller skate structure, and more particularly pertains to new and improved pneumatic pump roller blades wherein the same is directed to the use of roller blade skate members having pneumatic side wall chambers within the shoe construction for support and comfort of a wearer.

2. Description of the Prior Art

Wheeled roller blades are available in the prior art and exemplified by U.S. Pat. Nos. 3,823,952; 4,699,390; 4,132,425; and 5,028,058.

The instant invention attempts to overcome deficiencies of the prior art by providing for pneumatically filled side wall chambers within the shoe structure of the invention to afford stability and comfort to a wearer of the roller blade organizations and in this respect, the present invention substantially fulfills this need.

SUMMARY OF THE INVENTION

In view of the foregoing disadvantages inherent in the known types of roller blade structure now present in the prior art, the present invention provides pneumatic pump roller blades wherein the same are directed to pneumatic chambers mounted within the side walls of an associated shoe structure. As such, the general purpose of the present invention, which will be described subsequently in greater detail, is to provide new and improved pneumatic pump roller blades which have all the advantages of the prior art roller blade apparatus and none of the disadvantages.

To attain this, the present invention provides shoe members having spaced parallel support flanges, wherein the flanges includes a row of rotatably mounted wheels therebelow and fashioned as roller blade structure, having a pneumatic chamber within the side wall of the shoe structure of the roller blades employing a pneumatic pump bladder mounted relative to the tongue structure of the shoe to permit selective filling of the pneumatic side wall chamber.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved pneumatic pump roller blades which has all the advantages of the prior art roller blade apparatus and none of the disadvantages.

It is another object of the present invention to provide new and improved pneumatic pump roller blades which may be easily and efficiently manufactured and marketed.

It is a further object of the present invention to provide new and improved pneumatic pump roller blades which is of a durable and reliable construction.

An even further object of the present invention is to provide new and improved pneumatic pump roller blades which is susceptible of a low cost of manufacture with regard to both materials and labor, and which accordingly is then susceptible of low prices of sale to the consuming public, thereby making such pneumatic pump roller blades economically available to the buying public.

Still yet another object of the present invention is to provide a new and improved pneumatic pump roller blades which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
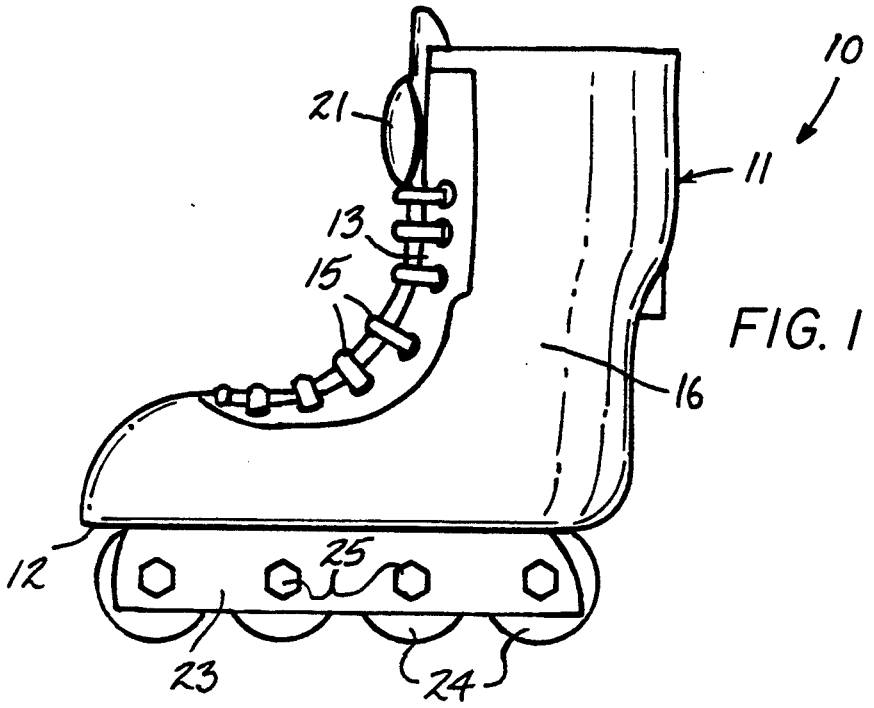
FIG. 1 is an orthographic side view of the invention.

With reference now to the drawings, and in particular to FIGS. 1 to 8 thereof, new and improved pneumatic pump roller blades embodying the principles and concepts of the present invention and generally designated by the reference numeral 10 will be described.

Figure 2:
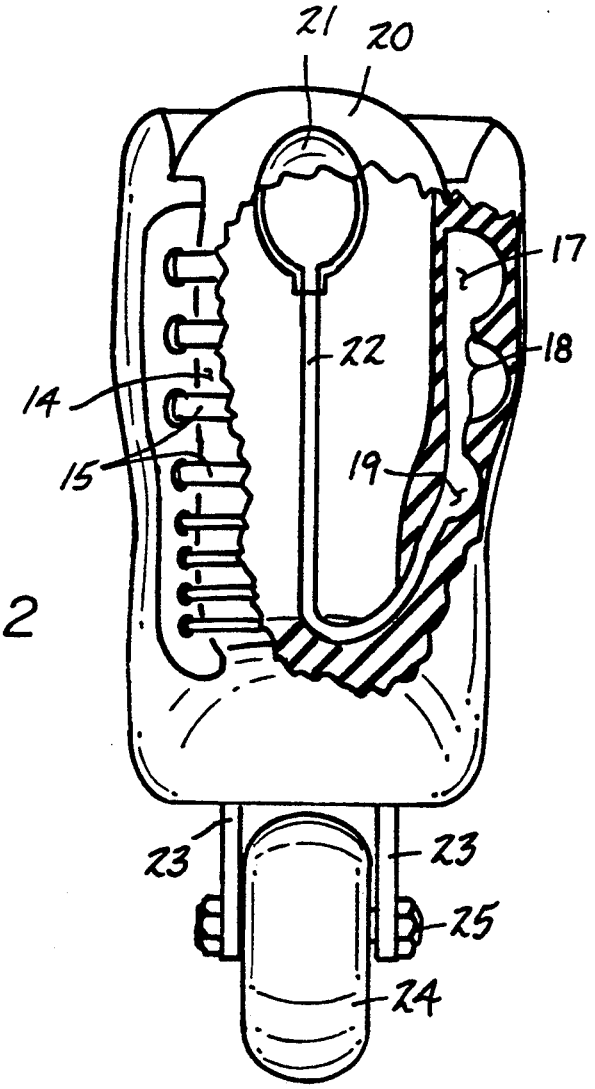
FIG. 2 is an orthographic front view of the invention, partially in section.

More specifically, the pneumatic pump roller blades 10 of the invention each include a shoe member 11, having a bottom wall 12 and a split front wall 13 defining a gap 14 between opposed sides of the front wall, with laces 15 directed along the gap, with a shoe tongue 20 positioned below the gap and coextensive therewith. A shoe U-shaped side wall 16 extends about the shoe structure, with the side wall 16 having a pneumatic chamber 17 therewithin coextensive relative to the side wall. The pneumatic chamber, as indicated in FIG. 2, indicates spaced ribs 18 and alternating arcuate recesses 19 coextensive with the pneumatic chamber 17. A pneumatic pump bladder 21 is provided, having a pneumatic conduit 22 in pneumatic communication between the pump bladder 21 and the chamber 17, whereupon manipulation of the pump bladder 21 effects pressurizing of the chamber 17.

Figure 3:
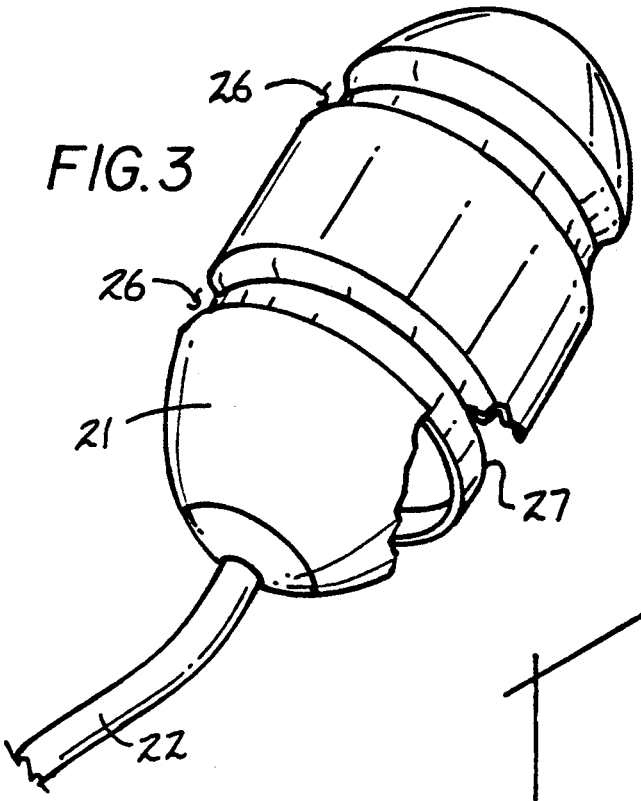
FIG. 3 is an enlarged isometric illustration of the pump structure of the invention.

The pump bladder 21, as indicated in FIG. 3, is arranged to include spaced angular grooves 26, with each groove having a groove resilient ring floor hoop 27 formed of a shape retentent material. The grooves 26 permit the laces 15 to be received within the grooves 26 to assist in positioning of the pump bladder relative to the tongue structure 20.

Figure 4:
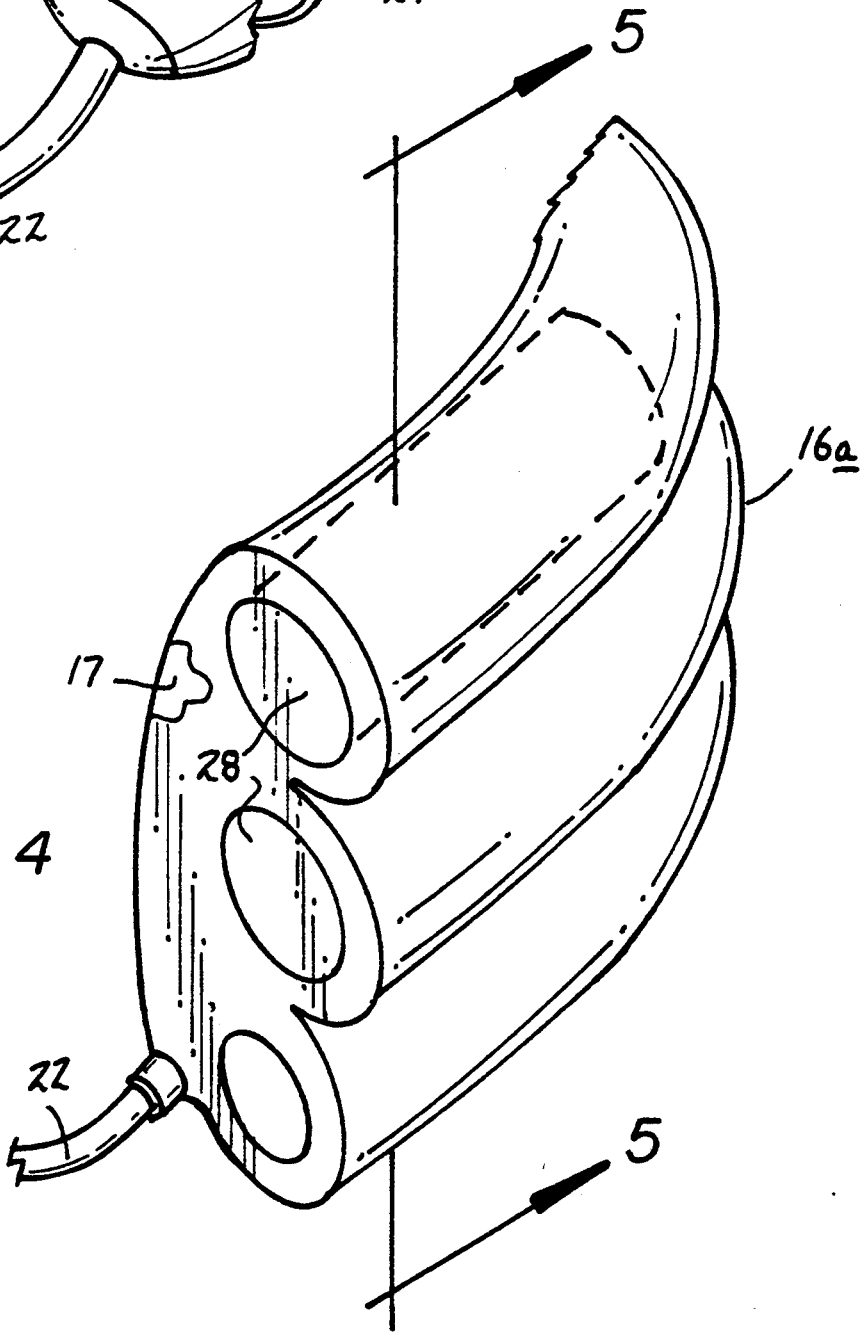
FIG. 4 is an isometric illustration of a modified pneumatic chamber structure of the invention.
Figure 5:
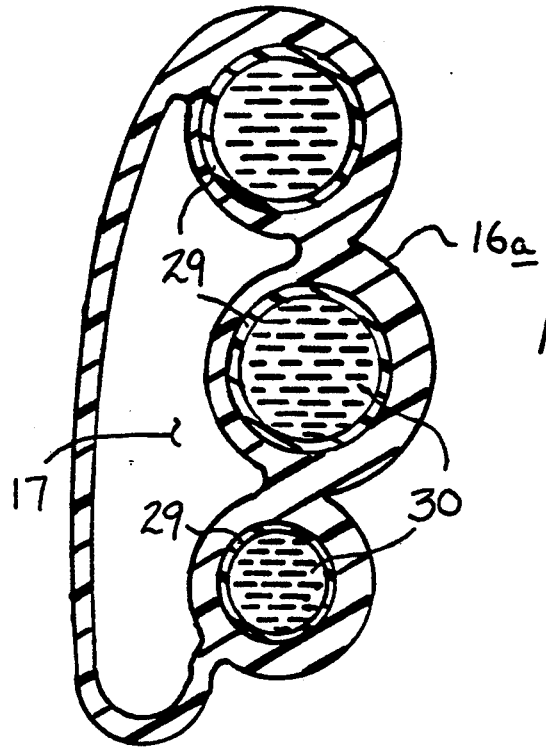
FIG. 5 is an orthographic view, taken along the lines 5—5 of FIG. 4 in the direction indicated by the arrows.
Figure 6:
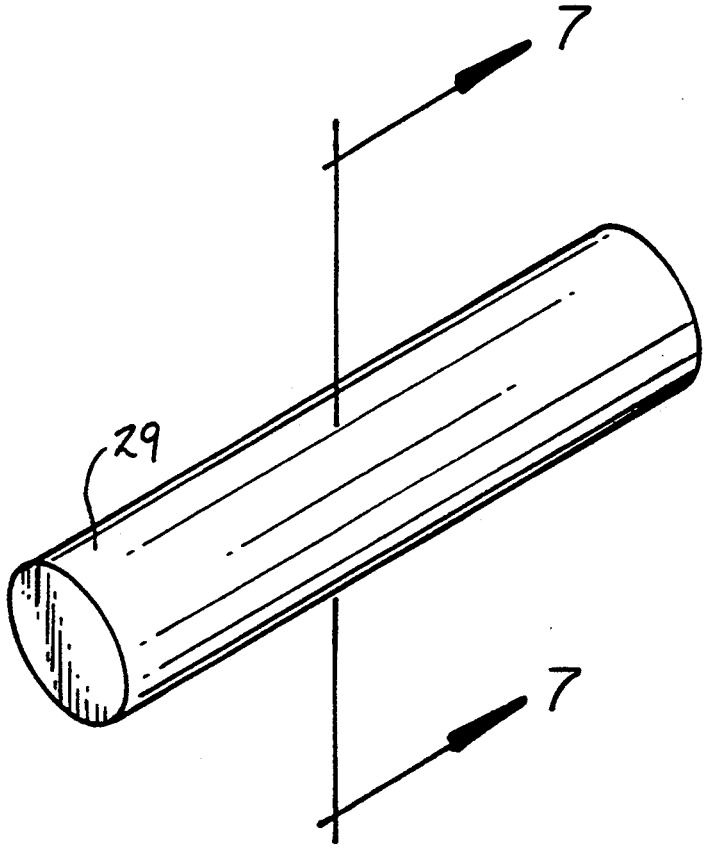
FIG. 6 is an enlarged isometric illustration of a fluid container received within the chamber structure, as indicated in FIG. 5.
Figure 7:
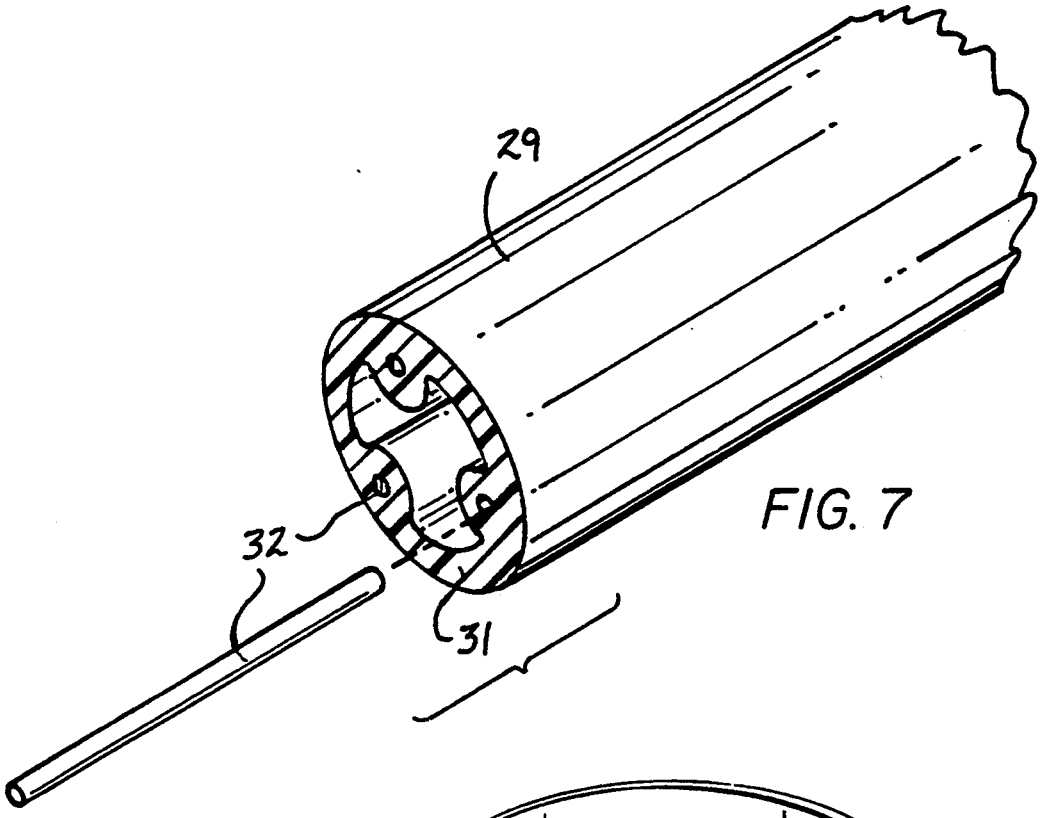
FIG. 7 is an isometric illustration, taken along the lines 7—7 of FIG. 6 in the direction indicated by the arrows.
Figure 8:
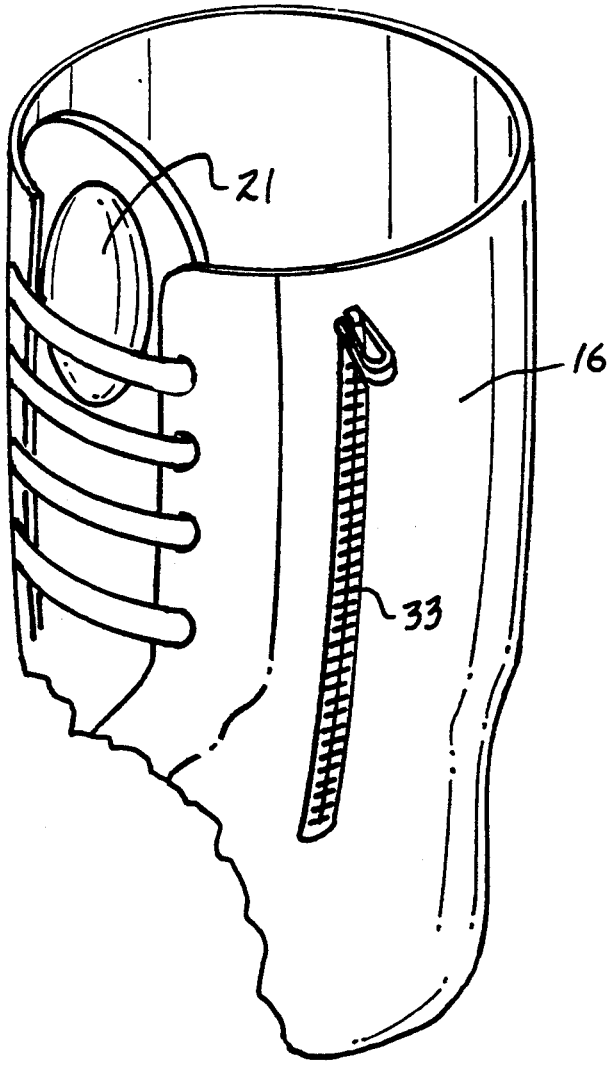
FIG. 8 is an isometric illustration of the shoe structure employing a zipper pocket for access to the pneumatic chamber insert of the invention.

The FIG. 8 indicates a zippered pocket access zipper 33 providing access within the side wall 16 to contain an interior side wall bladder **16*a* in pneumatic communication with the conduit 22, in a manner as indicated in FIG. 4. An insert structure is arranged to include spaced parallel cylindrical cavities 28, each arranged to receive a flexible cylindrical fluid container 29. The fluid containers 29 are arranged to have a compressible fluid 30 therewithin, and may optionally employ flexible rods 32 within the container side wall 31 to provide additional stiffening to the containers 29 when positioned within the cavities 28**. In this manner, enhanced shock absorbency is afforded in the use and wearing of the shoe structure.

It should be further noted that a plurality of spaced parallel flanges 23 are fixedly and orthogonally mounted to the shoe member bottom wall 12, wherein the flanges 23 are arranged in a parallel coextensive relationship relative to one another, having a row of wheel members 24 between the flanges, wherein each of the wheel members 24 is rotatable about an axle 25, wherein the axles are parallel relative to one another.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. Pneumatic pump roller blades, comprising, at least one shoe member, the shoe member having a shoe member bottom wall and a front wall, with the front wall having an elongate split defining a gap, a plurality of laces directed along the gap, with the shoe member having a shoe tongue positioned within the gap within the shoe member and coextensive with the gap, the shoe member further including a U-shaped side wall extending about the shoe member from the gap, and the side wall having a pneumatic chamber therewithin, a pump bladder mounted between the laces and the tongue, including a pneumatic conduit in pneumatic communication between the pump bladder and the pneumatic chamber, a plurality of spaced parallel flanges fixedly and orthogonally mounted to the shoe member bottom wall, wherein the flanges include a row of wheel members, wherein each of the wheel members is rotatable about a respective axle, and the bladder includes a plurality of annular grooves, wherein each of the grooves is arranged to receive a lace member of said laces, and each of the annular grooves includes a groove resilient ring floor hoop, wherein each hoop is formed of a shape retentent material.

2. Pneumatic pump roller blades as set forth in claim 1 wherein the side wall includes a side wall pocket, and an insert positioned within the pocket, and the insert having said pneumatic chamber therewithin, and the insert further including a plurality of parallel cylindrical cavities, wherein each of the cavities includes a removably mounted flexible cylindrical fluid container, and each fluid container includes a compressible fluid therewithin.

3. Pneumatic pump roller blades as set forth in claim 2 wherein each fluid container includes a container side wall, and each container side wall includes a plurality of flexible rods mounted therewithin to impart geometric integrity to said fluid container.

* * * * *